US006237962B1

(12) United States Patent
Lim

(10) Patent No.: US 6,237,962 B1
(45) Date of Patent: May 29, 2001

(54) TELESCOPABLE WAND ASSEMBLY OF A VACUUM CLEANER

(75) Inventor: Eui Suk Lim, Seoul (KR)

(73) Assignee: Daewoo Electronics Co., Ltd., Seoul (KR)

( * ) Notice: Subject to any disclaimer, the term of this patent is extended or adjusted under 35 U.S.C. 154(b) by 0 days.

(21) Appl. No.: 09/292,368

(22) Filed: Apr. 15, 1999

(30) Foreign Application Priority Data

Jun. 30, 1998 (KR) ..... 98-11787
Jun. 30, 1998 (KR) ..... 98-26057

(51) Int. Cl.[7] ..... F16L 21/00
(52) U.S. Cl. ..... 285/7; 285/303
(58) Field of Search ..... 285/7, 302, 303

(56) References Cited

U.S. PATENT DOCUMENTS

| | | | | |
|---|---|---|---|---|
| 2,582,446 | * | 1/1952 | Martinet | 285/7 |
| 2,637,062 | * | 5/1953 | Sutton et al. | 285/7 |
| 2,912,261 | * | 11/1959 | Meyerhoefer | 285/7 |
| 3,244,437 | * | 4/1966 | Belicka et al. | 285/303 |
| 3,351,359 | * | 11/1967 | Feraris | 285/7 |
| 5,046,761 | | 9/1991 | Cordes . | |
| 5,332,266 | | 7/1994 | Canale . | |
| 5,462,311 | | 10/1995 | Cipolla . | |
| 5,568,943 | | 10/1996 | Kilstrom et al. . | |
| 5,692,782 | * | 12/1997 | Fischer | 285/7 |
| 5,941,575 | * | 8/1999 | Herbst | 285/7 |

FOREIGN PATENT DOCUMENTS

| | | |
|---|---|---|
| 293 518 | 12/1988 | (EP) . |
| 399 177 | 11/1990 | (EP) . |
| 520 534 | 12/1992 | (EP) . |
| 537 457 | 4/1993 | (EP) . |
| 552 481 | 7/1993 | (EP) . |
| 553 482 | 8/1993 | (EP) . |
| 601 620 | 6/1994 | (EP) . |

* cited by examiner

*Primary Examiner*—Eric Nicholson
(74) *Attorney, Agent, or Firm*—Pillsbury Winthrop LLP

(57) ABSTRACT

A telescopable wand assembly of a vacuum cleaner. The assembly has a first pipe communicated with a nozzle portion and including a main body made of synthetic resin and a notch portion made of metal, a second pipe communicated with a handle portion and telescopably receiving a part of the first pipe, a knob portion and a rod for interlocking the first and second pipes such that the first and second pipes are slidable by discrete intervals, a cylinder member guiding the first pipe into the second pipe and confining the rod, a rubber ring for sealing a gap between the first and second pipes, and a stopper for supporting the rubber ring.

9 Claims, 8 Drawing Sheets

TELESCOPABLE WAND ASSEMBLY OF A VACUUM CLEANER

BACKGROUND OF THE INVENTION

1. Field of the Invention

The present invention relates to a vacuum cleaner, and more particularly to a telescopable wand assembly of a vacuum cleaner which is selectively adjustable in length and provides an improved sealing structure.

2. Description of the Prior Art

A vacuum cleaner is a device for sucking dust or debris on a floor by a suction force generated by a motor. Generally, the vacuum cleaner includes a wheel-mounted main body, the motor generating the suction force, and a dust collecting chamber receiving the dusts and debris drawn into the main body. A flexible hose extends from the main body to a brush which draws the dust and debris on the floor.

FIG. 1 shows a conventional canister type vacuum cleaner 10. Referring to FIG. 1, vacuum cleaner 10 comprises a plurality of sub-assemblies that a user can easily assemble for use or disassemble for storage.

Vacuum cleaner 10 includes a canister housing 12 connected through a hose 14 to a handle assembly 16. Handle assembly 16 is connected to a floor engaging nozzle 24 through a wand assembly 18 having a tubular wand portion 20 and a dust cup assembly 22.

Although not shown, housing 12 includes a motor which develops vacuum pressure at an opening 26 to draw dust and debris into a dust bag 28 as is well known. Housing 12 includes a canister hood assembly 30 for mounting attachments and a cover 32 for enclosing such attachments.

Handle assembly 16 includes an outwardly extending metal tube 46 in communication with a quick release element 38. Tube 46 includes a swaged male end 48 receivable in an expanded female end 50 of a wand tube 20. Referring also to FIG. 2, tube male end 48 includes a quick release element 52 receivable in an aperture 54 in wand tube 20 for interlocking tubes 46 and 20.

However, in the conventional vacuum cleaner as described above, the wand tube is fixed in length without taking account of a height of the user and a space of a room to be cleaned.

Meanwhile, U.S. Pat. No. 5,568,943 discloses a telescopic tube connection for a vacuum cleaner. The vacuum cleaner has a hose which is connected to a vacuum cleaner housing. An outer end of the hose has a tube handle. The tube handle is connected to a nozzle by a tube shaft. The tube shaft is movable relative to the tube handle and can be releasably locked in different positions. The cleaner is conveniently provided to allow the operator to adjust the relative length of the tube shaft by moving the tube shaft relative to the tube handle.

SUMMARY OF THE INVENTION

The present invention is intended to provide an improved structure superior to the above described conventional structures. Therefore, the object of the present invention is to provide a telescopable wand assembly of a vacuum cleaner in which a metal plate formed with a plurality of notches thereon is attached to a light weight pipe such that the metal plate engages with a locking mechanism of a pipe extending from a handle portion and in which an improved sealing structure is provided between the two pipes, thereby preventing an air leakage therebetween.

In order to achieve the above object of the present invention, there is provided a telescopable wand assembly of a vacuum cleaner having a handle portion and a nozzle portion, the assembly comprising: a first pipe communicated with the nozzle portion and including a main body made of a synthetic resin and a notch portion made of a metal, the notch portion being attached to an outer surface of the main body; a second pipe communicated with the handle portion and receiving a part of the first pipe; a first means for interlocking the first and second pipes in such a manner that the first and second pipes are slidable with respect to each other by discrete intervals, the first means including a rod making contact with the notch portion and a knob portion suppressing and releasing the rod; a second means for guiding a sliding of the first pipe into the second pipe and blocking a longitudinal movement of the rod with respect to the second pipe; a third means for sealing a gap between the first and second pipes; and a fourth means for supporting the third means and preventing the first pipe from being entirely separated from the second pipe.

The main body of the first pipe is formed at an upper portion thereof with a cut-off portion extending along a longitudinal direction thereof, the cut-off portion being formed at both radial ends thereof with stepped portions respectively, and the notch portion includes a metal plate substantially identical to the cut-off portion in shape and is formed at an upper surface thereof with a plurality of transverse notches spaced apart form each other by predetermined intervals in the longitudinal direction of the first pipe, the notch portion being formed at both sides thereof with bending portions respectively, each of which engaging with respective stepped portion.

The stepped portion is formed with at least one projection, and the notch portion is formed at a position thereof corresponding to the projection with a hole which engages with the projection.

The first means is provided at an upper portion of the second pipe, the knob portion including a knob movable in the longitudinal direction of the second pipe and formed at an upper portion thereof with a dome portion, a rib downward extending from the knob and a scroll formed upwardly from a lower end of the rib, and the first and second pipes being engaged when the rod is positioned between the rib and one of the notches of the first pipe, the first and second pipes being slidable when the rod is received in the scroll.

A front end of the knob portion makes contact with a compression spring which is in turn supported by the second pipe so that the knob portion is urged rearwardly with respect to the longitudinal direction of the second pipe, the rib of the knob portion suppressing the rod when the knob portion is in a normal position, and the rod being disengageable from the notch of the first pipe when an external force urges the knob so as to move the knob and thereby the scroll is translated above the rod.

The second means includes a hollow cylinder member having a predetermined length and fixedly inserted into the second pipe, an inner surface of the cylinder member making contact with the outer surface of the first pipe so as to slidably guide the first pipe, the cylinder member being formed at a position thereof facing the rod with a slot for allowing the rod to vertically move therethrough.

The third means includes a rubber ring press-fitted into the second pipe, positioned behind the cylinder member and having a corrugated shape along a radial direction thereof.

The fourth means includes a stopper provided behind the rubber ring in the second pipe and having an engageable shape with the rubber ring, the stopper being engaged with the rubber ring to minimizing deflections of the rubber ring in longitudinal and radial directions with respect to the second pipe.

The first pipe is formed at an underside thereof with a guide groove extending to a portion adjacent to an end of the first pipe engaging with the second pipe, and the stopper is formed at an underside thereof with a tab inserted into the guide groove so as to prevent the first pipe from rotating with respect to the second pipe and to prevent the first pipe from being entirely separated from the second pipe by abutting to an end of the guide groove.

The stopper is cut at an upper end thereof so that the stopper is deformable in size within a predetermined range.

As described above, the main body of the first pipe is made of synthetic resin whereas only the notch portion is made of metal, which enables the first pipe to be light in weight and prevents the notch portion from being easily worn, hereby reducing a manufacturing cost thereof.

In addition, the wand assembly can be easily changeable in length thereof by manipulating the knob portion. Furthermore, the rubber ring is supported by the stopper so as to be maintained its shape, resulting more secure sealing.

BRIEF DESCRIPTION OF THE DRAWINGS

The above object and other advantages of the present invention will become more apparent by describing in detail preferred embodiments thereof with reference to the attached drawings in which.

DETAILED DESCRIPTION OF THE INVENTION

Hereinafter, a preferred embodiment of the present invention will be explained in more detail with reference to the accompanying figures.

Figure 1:
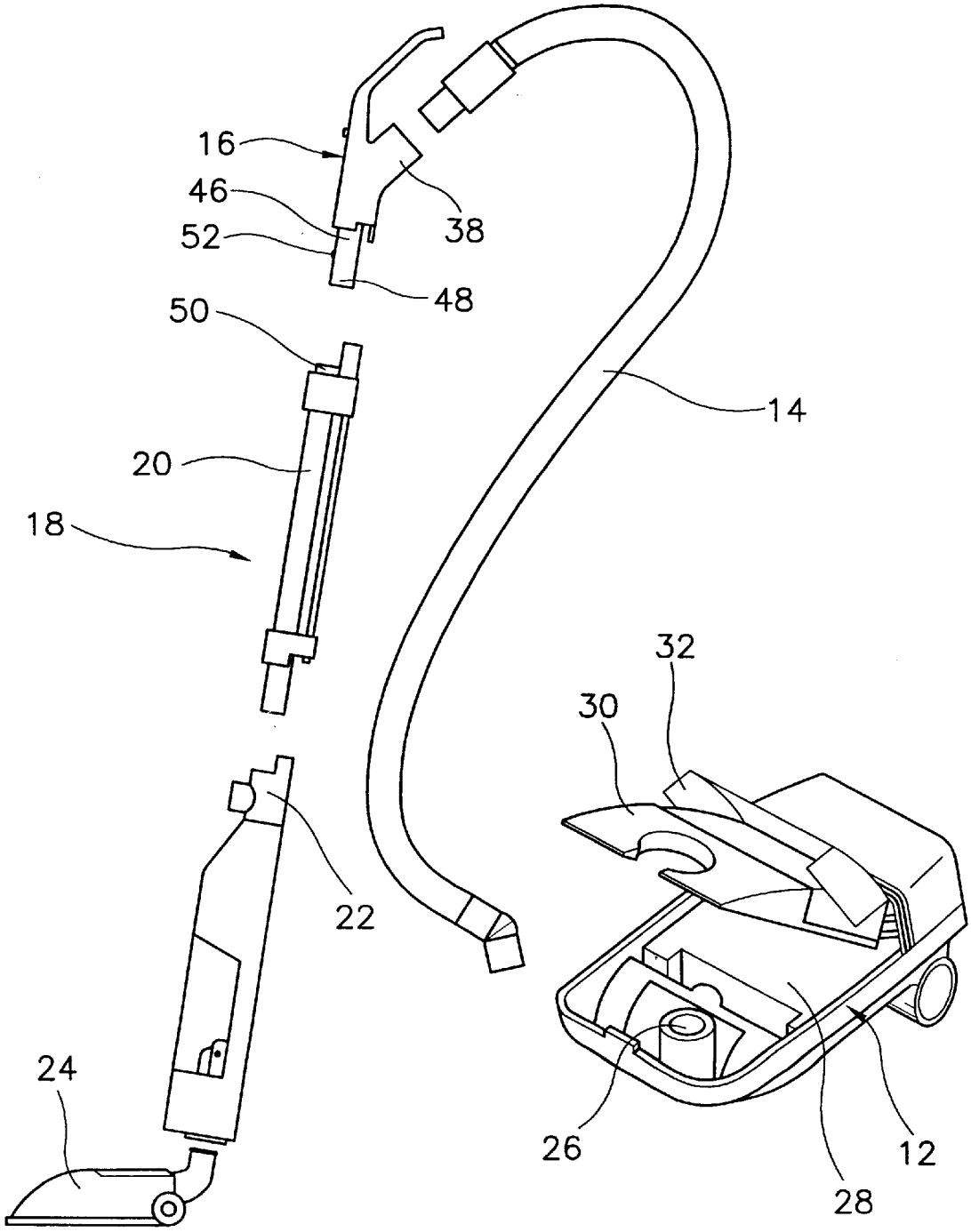
FIG. 1 (PRIOR ART)
FIG. 1 is a perspective view of a conventional vacuum cleaner.
Figure 2:
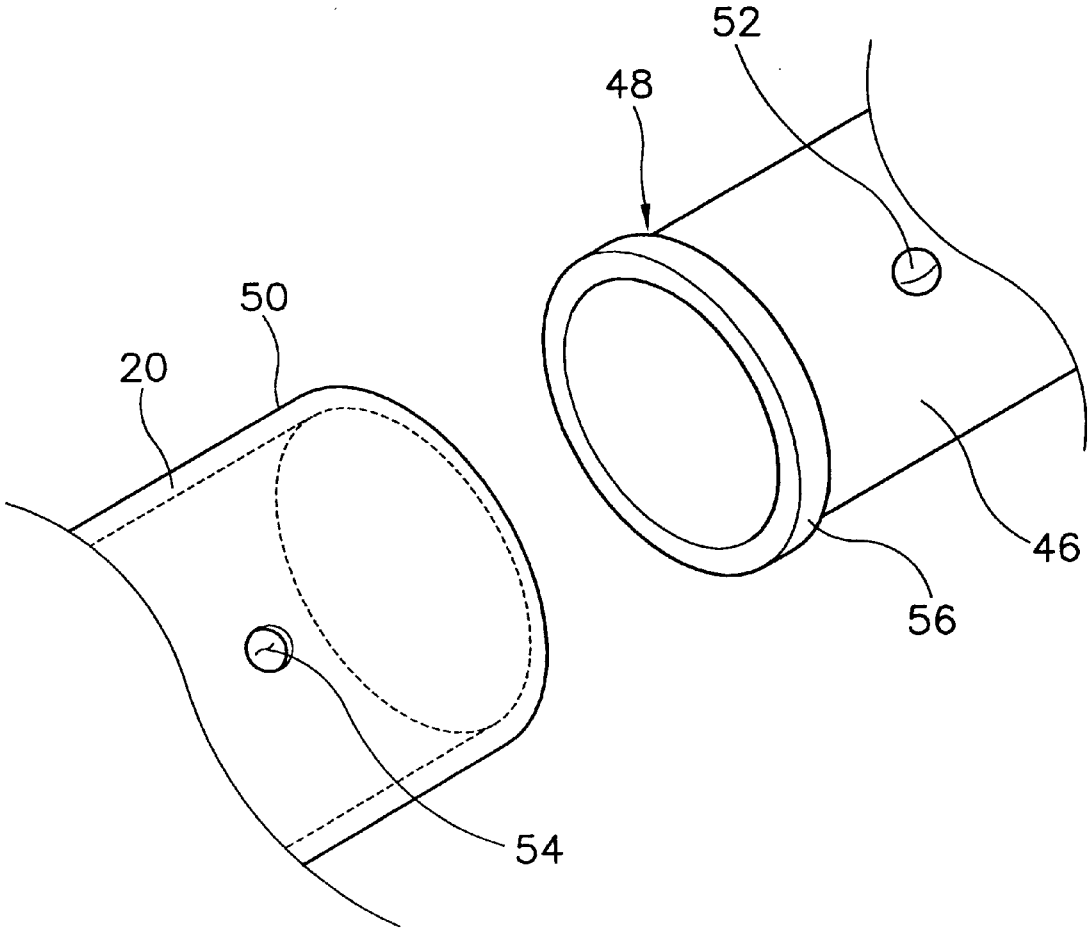
FIG. 2 (PRIOR ART)
FIG. 2 is a perspective view of an engaging portion between a handle portion and a wand portion.
Figure 3:
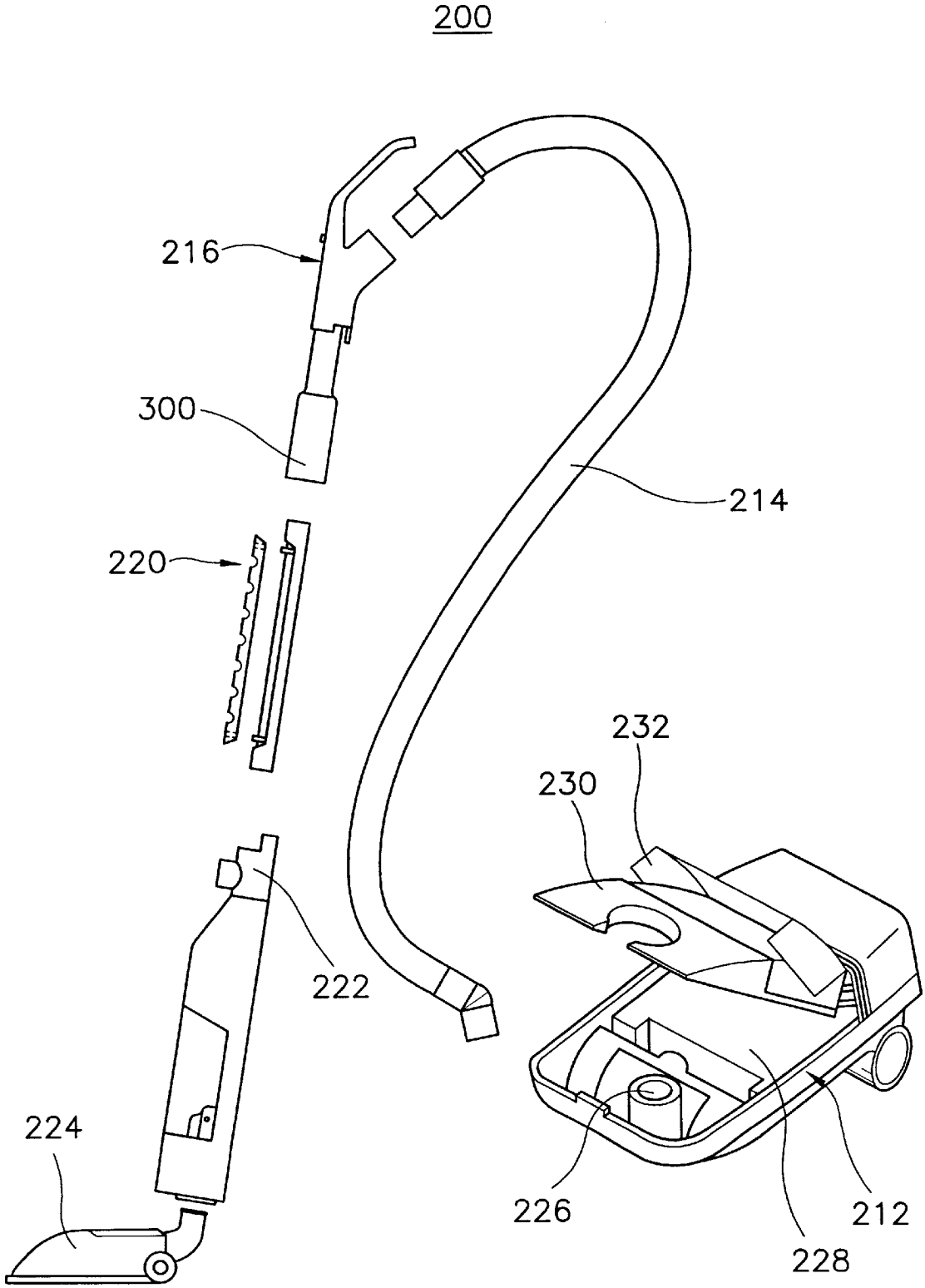
FIG. 3 is a perspective view of a vacuum cleaner according to the present invention.

FIG. 3 shows a vacuum cleaner 200 in accordance with the present invention. Vacuum cleaner 200 includes a housing 212 connected through a hose 214 to a handle portion 216. Handle portion 216 is connected to a nozzle portion 224 through first and second pipes 220 and 300 and a dust cup assembly 222.

Although not shown, housing 212 includes a motor which develops vacuum pressure at an opening 226 to draw dust and debris into a dust bag 228, as is well known. Housing 212 includes a canister hood assembly 230 for mounting attachments and a cover 232 for enclosing such attachments.

Figure 4A:
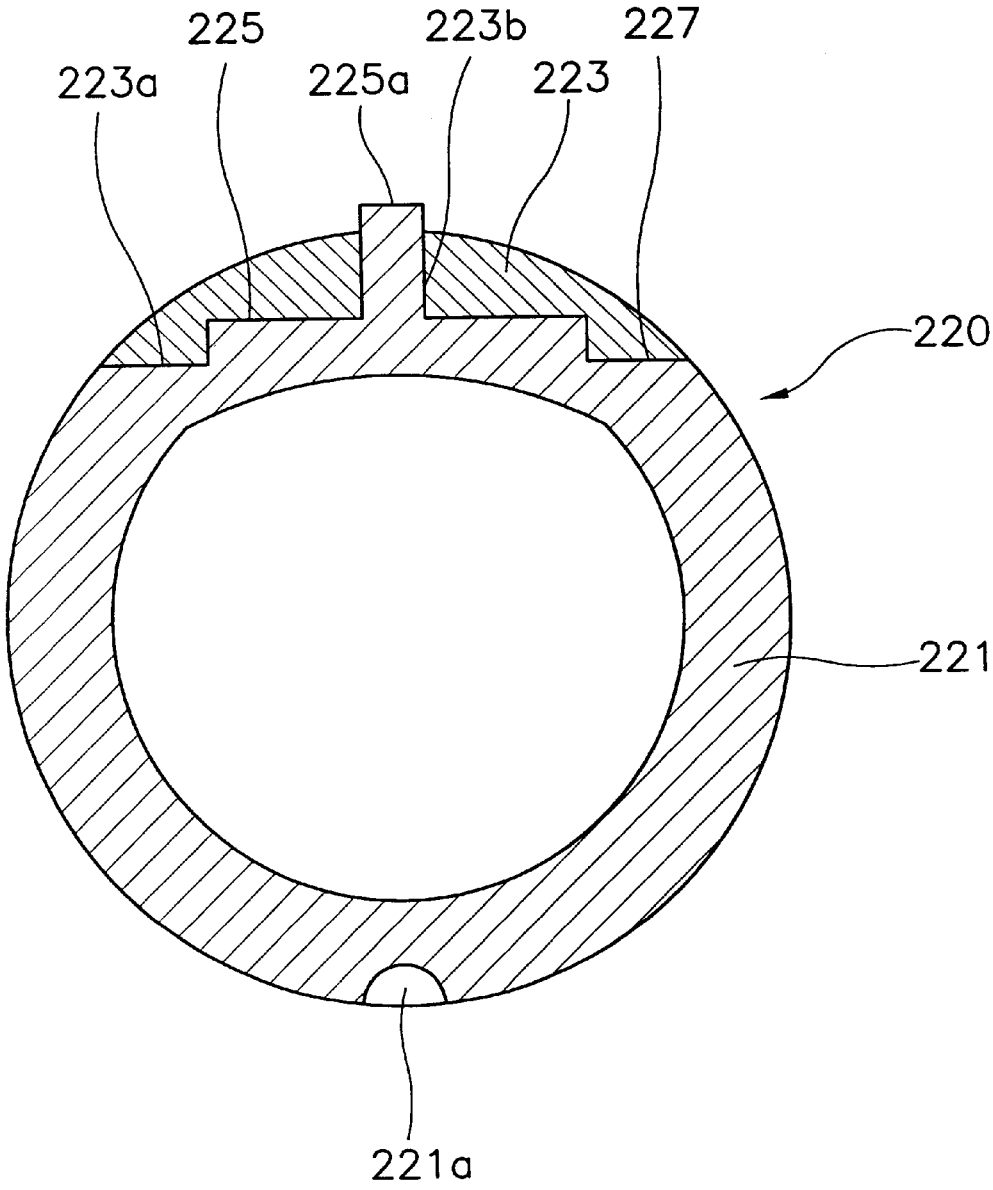
FIG. 4*a* is a sectional view of a first pipe in accordance with a preferred embodiment.
Figure 4B:
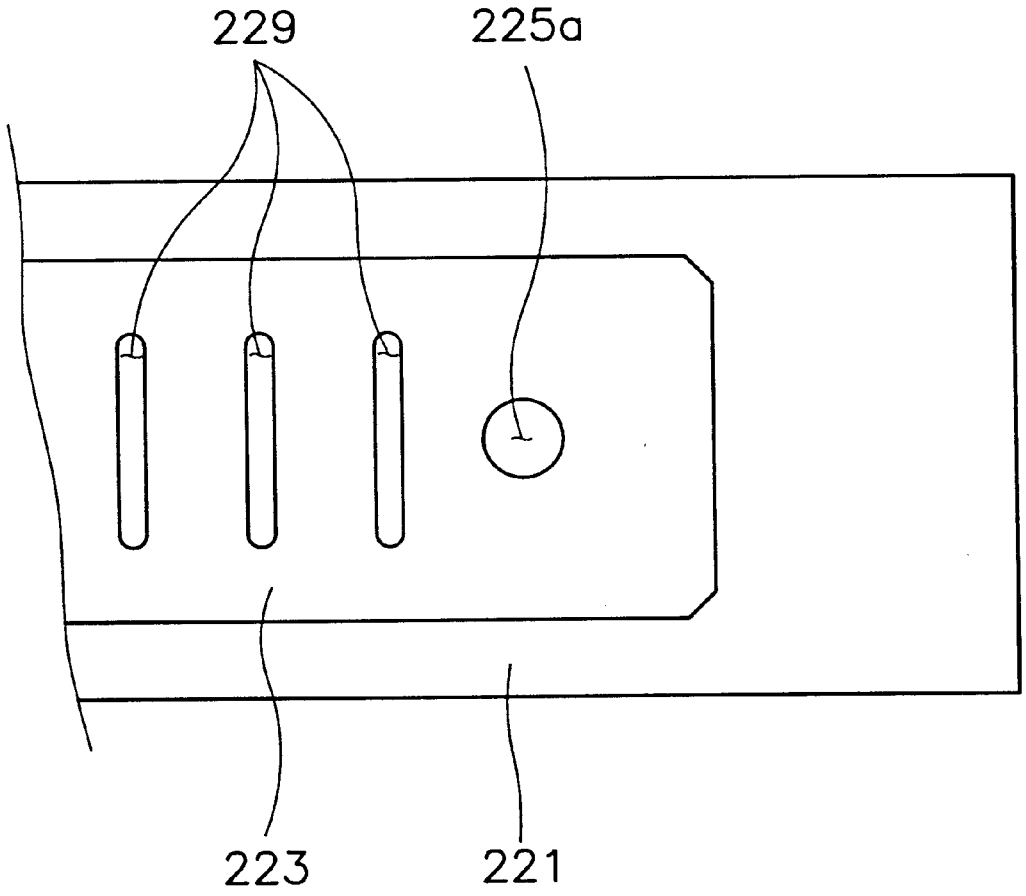
FIG. 4*b* is a plan view of the first pipe shown in FIG. 4*a;*

FIG. 4*a* is a sectional view of a first pipe in accordance with a preferred embodiment. Referring to FIGS. 3 and 4*a*, first pipe 220 is communicated with nozzle portion 224. First pipe 220 includes a main body 221 made of synthetic resin and a notch portion 223 which is made of metal and is attached to an upper surface of the main body 221. The main body 221 of the first pipe 220 is formed at an upper portion thereof with a cut-off portion 225 having a predetermined depth and extending along a longitudinal direction thereof, and the cut-off portion 225 is formed at both radial ends thereof with stepped portions 227 respectively. The notch portion 223 includes a metal plate substantially identical to the cut-off portion 225 in shape and size and is, referring to FIG. 4*b*, formed at an upper surface thereof with a plurality of transverse notches 229 spaced apart form one another by predetermined intervals in the longitudinal direction of the first pipe 220. Also, the notch portion 223 is formed at both sides thereof with bending portions 223*a* respectively, each of which engaging with respective stepped portion 227.

The cut-off portion 225 is formed with at least one projection 225*a*, and the notch portion 223 is formed at a position thereof corresponding to the projection 225*a* with a hole 223*b* which engages with the projection 225*a*. On the other hand, the first pipe 220 is formed at an underside thereof with a guide groove 221*a* extending to a portion adjacent to an end of the first pipe 220 engaging with the second pipe 300.

Figure 5:
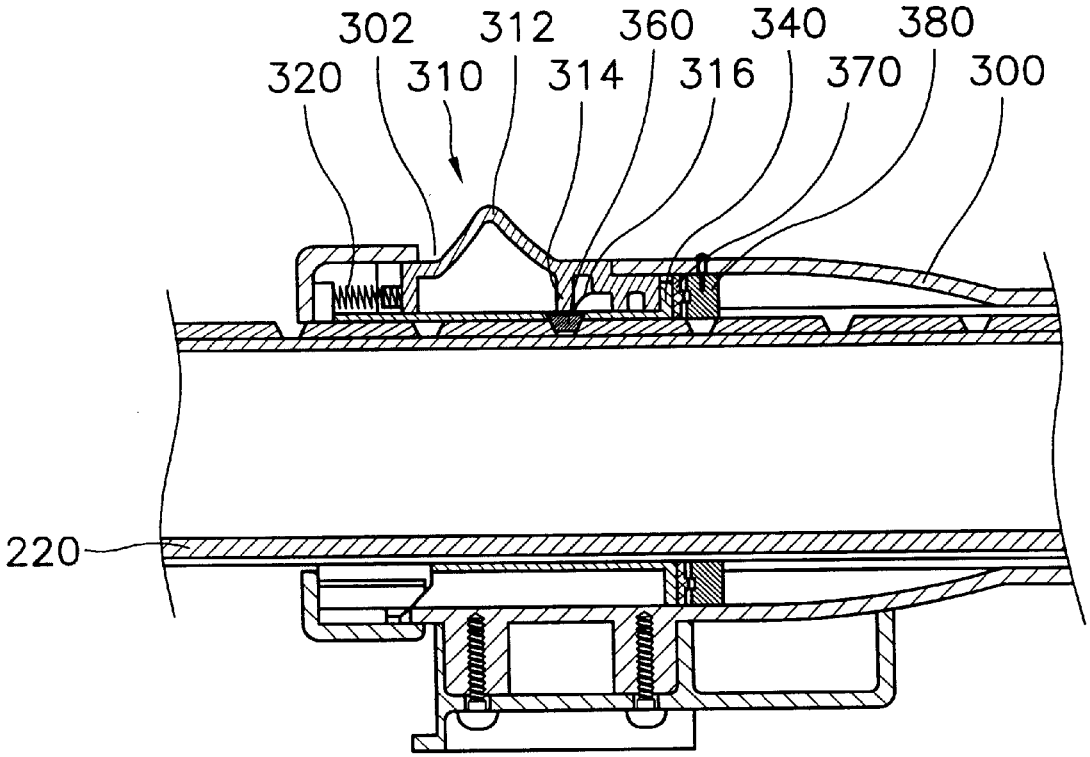
FIG. 5 is a sectional view of a telescopable wand assembly in accordance with a preferred embodiment.

FIG. 5 shows the first and second pipes 220 and 300 in which a part of the first pipe 220 is inserted into the second pipe 300. For understanding better, it should be understood that the first and second pipes 220 and 300 approximately means the "wand". Referring to FIGS. 3 and 5, the second pipe 300 is communicated with the handle portion 216. According to a preferred embodiment of the present invention, there is provided an interlocking structure for interlocking the first and second pipes 220 and 300 in such a manner that the first and second pipes 220 and 300 are slidable with respect to each other by discrete intervals.

For this purpose, a knob portion 310 is provided at an upper portion of the second pipe 300. The knob portion 310 is slidable in the longitudinal direction of the second pipe 300, and the second pipe 300 is formed at the upper portion thereof with an opening 302 so as to allow the knob portion 310 to move therealong. The knob portion 310 includes a knob 312 movable in the longitudinal direction of the second pipe 300 and is formed at an upper portion thereof with a dome portion, a rib 314 downward extending from the knob 312, and a scroll 316 formed upwardly from a lower end of the rib 314. A front end of the knob portion 310 makes contact with a compression spring 320 which is in turn supported by a front end portion of the second pipe 300 so that the knob portion 310 is urged rearwardly in the longitudinal direction of the second pipe 300.

Figure 6:
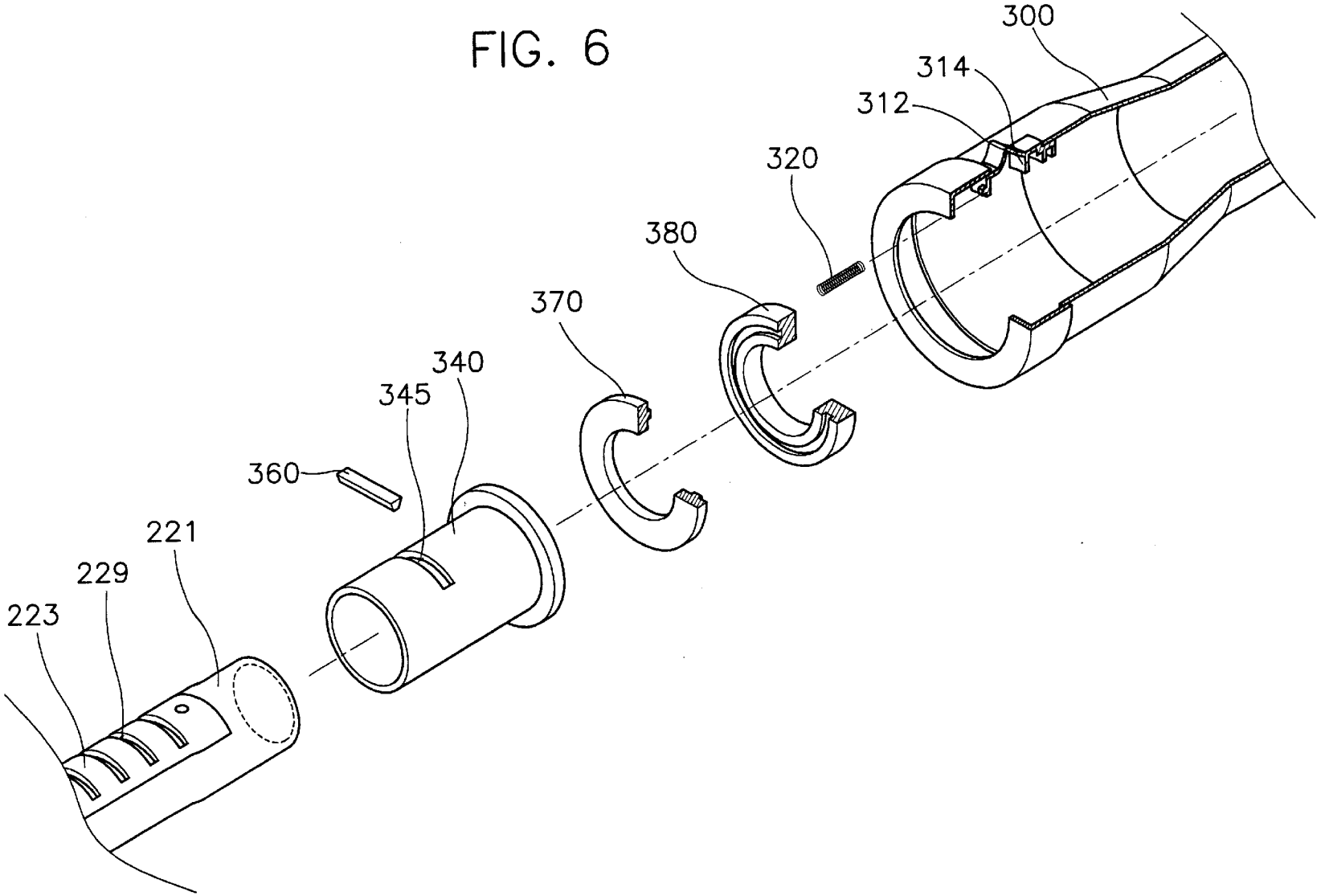
FIG. 6 is an exploded perspective view of the telescopable wand assembly.

FIG. 6 shows an exploded view of the telescopable wand assembly in accordance with a preferred embodiment of the present invention. Referring to FIG. 6, a cylinder member 340 is provided for guiding a sliding of the first pipe 220 into the second pipe 300. The cylinder member 340 is a hollow member having a predetermined length and fixedly inserted into the second pipe 300. When the first pipe 220 slides within the second pipe 300, an inner surface of the cylinder member 340 makes contact with the outer surface of the first pipe 220 so as to slidably guide the first pipe 220. The cylinder member 340 is formed at a predetermined position thereof with a slot 345 for allowing a rod 360 to vertically move therethrough, which will be described below.

On the other hand, a rod 360 is provided for interlocking the first and second pipes 220 and 300 when the rod 360 is positioned between the rib 314 and one of the notches 229 of the first pipe 220. The rod 360 is substantially identical to the notches 229 on the first pipe 220 in size. The rod 360 is vertically movable through the slot 345 formed at the cylinder member 340, but the slot 345 restricts a horizontal movement of the rod 360.

Referring again to FIG. 5 again, when there is no external force on the knob 312, the rib 314 faces with the slot 345 of the cylinder member 340. On the contrary, when a user pushes the knob 312 forwardly, the rib 314 is shifted from the rod 360 so that the rod 360 can be receivable in the scroll 316. At this time, the first and second pipes 220 and 300 can slide with respect to each other. More detailedly, when the knob 312 is in a normal position, the rib 314 suppresses the rod 360 into one of the notches 229 on the first pipe 220 so that the wand assembly, that is, the first and second pipes 220 and 300 are maintained in a constant length. On the other hand, when the knob 312 is shifted by the user's push, the scroll 316 of the knob portion 310 is positioned above the rod 360 so that the rod 360 can escape from the engaging notch 229. At this time, the user can lengthen or shorten the wand assembly by letting the first and second pipes 220 and 300 slide. Meanwhile, the cylinder member 340 confines the rod 360 in the longitudinal direction of the second pipe 300 so that the rod 360 does not follow the notches 229.

In general, an inner pressure of the wand assembly is lower than an atmospheric pressure, so an ambient air may penetrates between the first and second pipes 220 and 300. In this case, some of the suction force by the motor(not shown) is dissipated. According to a preferred embodiment of the present invention, in order to seal a gap between the first and second pipes 220 and 300, a rubber ring 370 is provided. The rubber ring 370 is press-fitted into the second pipe 300, and is positioned behind the cylinder member 340. As shown in FIGS. 5 and 6, the rubber ring 370 has a corrugated shape along a radial direction thereof.

Figure 7:
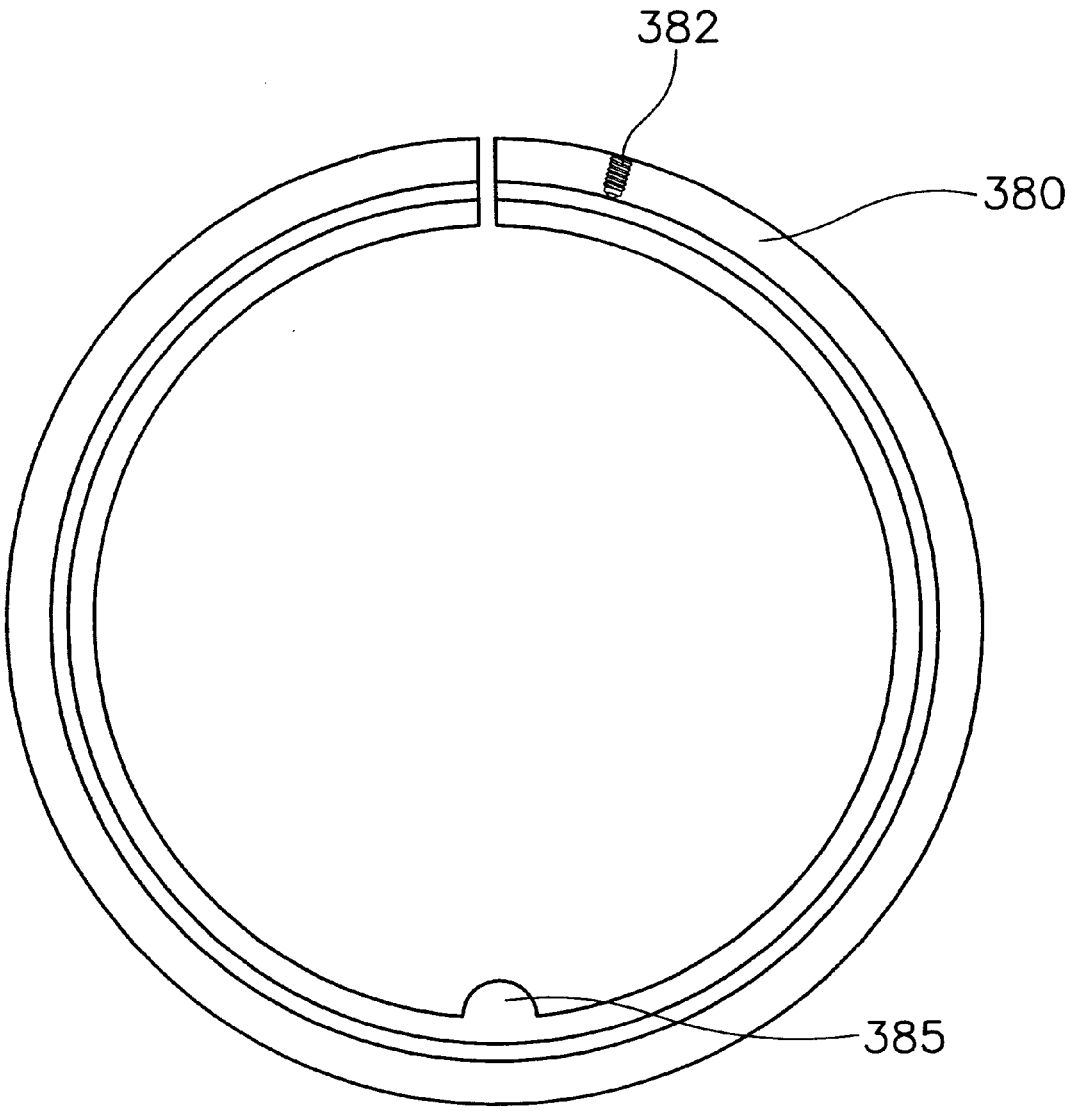
FIG. 7 is a front view of a stopper.

However, since the rubber ring 370 is flexible, it can be deformed by a pressure difference and furthermore can be moved. According to a preferred embodiment of the present invention, in order to support the rubber ring 370, a ring shaped stopper 380 is provided as shown in FIG. 7. The stopper 380 is secured into the second pipe 300 and is positioned behind the rubber ring 370. The stopper 380 has an engageable shape with the rubber ring 370 and is engaged with the rubber ring 370 to minimizing deflections of the rubber ring 370 in longitudinal and radial directions with respect to the second pipe 300.

The stopper 380 also functions to prevent the first pipe 220 from being entirely separated from the second pipe 300. As previously described, the first pipe 220 is formed at the underside thereof with the guide groove 221*a*, as shown in FIG. 4*a*, which extends to a portion adjacent to an end of the first pipe 220 engaging with the second pipe 300, and the stopper 380 is formed at an underside thereof with a tab 385 inserted into the guide groove 221*a* so as to prevent the first pipe 220 from rotating with respect to the second pipe 300 and to prevent the first pipe 220 from being entirely separated from the second pipe 300 by abutting to an end of the guide groove 221*a*.

While the rubber ring 370 can be resiliently deformed so as to allow the first pipe 220 to be inserted therethrough, the stopper 380 is rigid. Thus, to avoid a mismatch between the first pipe 220 and the stopper 380, the stopper 380 is cut at an upper end thereof so that the stopper 380 is deformable in size within a predetermined range.

Hereinafter, an assembling method and the adjustment of the telescopable wand assembly will be described. Referring to FIG. 6, firstly, the stopper 380 engaged with the rubber ring 370 is inserted into the second pipe 300 which is communicated with the handle portion 216 and then is secured to the second pipe 300 by screw means or the like. Preferably, the stopper 380 is formed at a side portion thereof with a tapped portion 382 as shown in FIG. 7. Thereafter, cylinder member 340 is inserted into the second pipe 300. At this time, to stably position the rod 360 in the slot 345 of the cylinder member 340, the cylinder member 340 is rotated at an angle of 180 degrees and is then inserted into the second pipe 300 together with the rod 360.

Then, the first pipe 220 is assembled. Firstly, the notch portion 223 is press-fitted to the upper portion of the main body 221, which constructs the first pipe 220. Thereafter, the first pipe 220 is inserted into the second pipe 300, and in turn into the cylinder member 340. Then, the cylinder member 340 is rotated at an angle of 180 degrees again so as to be positioned such that the slot 345 faces with the rib 314 of the knob portion 310 and accordingly to engage the rod 360 with one of the notches 229 of the first pipe 220. Thereafter, the cylinder member 340 is secured to the second pipe 300 by using screws or the like.

To change the length of the telescopable wand assembly while using the vacuum cleaner, the user can push the knob 312 forwardly and slide the first pipe 220 or the second pipe 300 with respect to each other until the rod 360 again engages with another notch 229.

As described above, the main body 221 of the first pipe 220 is made of synthetic resin and only the notch portion 223 is made of metal, which enables the first pipe 220 to be light in weight and prevents the notch portion 223 from being easily worn, thereby reducing the manufacturing cost thereof.

In addition, the telescopable wand assembly can be easily adjustable in length thereof by manipulating the knob portion 310. Furthermore, the rubber ring 370 is supported by the stopper 380 so as to be maintain its shape, thereby resulting in more secure sealing between the first and second pipes 220 and 300.

Although the preferred embodiment of the invention has been described, it is understood that the present invention should not be limited to these preferred embodiments, but various changes and modifications can be made by one skilled in the art within the spirit and scope of the invention as hereinafter claimed.

What is claimed is:

1. A telescopable wand assembly of a vacuum cleaner having a handle portion and a nozzle portion, the assembly comprising:

a first pipe communicated with the nozzle portion and including a main body made of a synthetic resin and a notch portion made of a metal, the notch portion being attached to an outer surface of the main body the main body of the first pipe being formed at an upper portion thereof with a cut-off portion extending along a longitudinal direction thereof, the cut-off portion being formed at both radial ends thereof with stepped portions respectively, and the notch portion including a metal plate substantially identical to the cut-off portion in shape and being formed at an upper surface thereof with a plurality of transverse notches spaced apart from each other by predetermined intervals in the longitudinal direction of the first pipe, the notch portion being formed at both sides thereof with bending portions respectively, each of which engaging with respective stepped portion;

a second pipe communicated with the handle portion and receiving a part of the first pipe;

a first means for interlocking the first and second pipes in such a manner that the first and second pipes are slidable with respect to each other by discrete intervals, the first means including a rod making contact with the notch portion and a knob portion suppressing and releasing the rod;

a second means for guiding a sliding of the first pipe into the second pipe and blocking a longitudinal movement of the rod with respect to the second pipe;

a third means for sealing a gap between the first and second pipes; and a fourth means for supporting the third means and preventing the first pipe from being entirely separated from the second pipe.

2. The assembly as recited in claim 1, wherein the cut-off portion is formed with at least one projection, and the notch portion is formed at a position thereof corresponding to the projection with a hole which engages with the projection.

3. The assembly as recited in claim 1, wherein the first means is provided at an upper portion of the second pipe, the knob portion including a knob movable in the longitudinal direction of the second pipe and formed at an upper portion thereof with a dome portion, a rib downward extending from the knob and a scroll formed upwardly from a lower end of the rib, the rod being substantially identical to the notches on the first pipe in size, and the first and second pipes being engaged when the rod is positioned between the rib and one of the notches of the first pipe, the first and second pipes being slidable when the rod is received in the scroll.

4. The assembly as recited in claim 3, wherein a front end of the knob portion makes contact with a compression spring which is in turn supported by the second pipe so that the knob portion is urged rearwardly with respect to the longitudinal direction of the second pipe, the rib of the knob portion suppressing the rod when the knob portion is in a normal position, and the rod being disengageable from the notch of the first pipe when an external force urges the knob so as to move the knob and thereby the scroll is translated above the rod.

5. The assembly as recited in claim 1, wherein the second means includes a hollow cylinder member having a predetermined length and fixedly inserted into the second pipe, an inner surface of the cylinder member making contact with the outer surface of the first pipe so as to slidably guide the first pipe, the cylinder member being formed at a position thereof facing the rod with a slot for allowing the rod to vertically move therethrough.

6. The assembly as recited in claim 5, wherein the third means includes a rubber ring press-fitted into the second pipe, positioned behind the cylinder member and having a corrugated shape along a radial direction thereof.

7. The assembly as recited in claim 6, wherein the fourth means includes a stopper provided behind the rubber ring in the second pipe and having an engageable shape with the rubber ring, the stopper being engaged with the rubber ring to minimizing deflections of the rubber ring in the longitudinal and radial directions with respect to the second pipe.

8. The assembly as recited in claim 7, wherein the first pipe is formed at an underside thereof with a guide groove extending to a portion adjacent to an end of the first pipe engaging with the second pipe, and the stopper is formed at an underside thereof with a tab inserted into the guide groove so as to prevent the first pipe from rotating with respect to the second pipe and to prevent the first pipe from being entirely separated from the second pipe by abutting to an end of the guide groove.

9. The assembly as recited in claim 7, wherein the stopper is cut at an upper end thereof so that the stopper is deformable in size within a predetermined range.

* * * * *